US005358280A

United States Patent [19]

Scales

[11] Patent Number: 5,358,280

[45] Date of Patent: Oct. 25, 1994

[54] APPARATUS FOR ASSEMBLING AND DISPLAYING INFORMATION

[76] Inventor: Thomas C. Scales, 6391 Glenridge Dr., No. 150, Atlanta, Ga. 30328

[21] Appl. No.: 208,053

[22] Filed: Mar. 8, 1994

Related U.S. Application Data

[63] Continuation of Ser. No. 144,729, Oct. 28, 1993, abandoned, which is a continuation of Ser. No. 32,432, Mar. 15, 1993, abandoned, which is a continuation of Ser. No. 746,911, Aug. 19, 1991, abandoned.

[51] Int. Cl.[5] ..... B42D 15/00

[52] U.S. Cl. ..... 283/63.1; 40/492; 281/15.1; 283/36; 283/37; 283/39; 283/40; 283/42; 283/114; 402/80 P

[58] Field of Search ..... 40/376, 492; 281/15.1, 281/21.1, 46; 283/63.1, 36, 37, 38, 39, 40, 41, 42, 43, 114, 117; 402/80 P

[56] References Cited

U.S. PATENT DOCUMENTS

| | | | |
|---|---|---|---|
| 100,994 | 3/1870 | Fitch et al. | 40/67 |
| 722,061 | 3/1903 | Waldo | 402/48 |
| 1,054,465 | 2/1913 | Sontheimer | 253/42 |
| 1,638,277 | 8/1927 | Smith | 40/376 X |
| 2,080,995 | 5/1937 | Baker | 40/376 |
| 2,156,551 | 5/1939 | Stark | 40/376 |
| 3,087,498 | 4/1963 | Vogel | 402/80 P X |
| 3,756,627 | 4/1973 | Reist | 283/42 X |
| 3,950,871 | 4/1976 | Rege | 40/492 |
| 4,104,809 | 8/1978 | Day et al. | 40/492 X |
| 4,244,603 | 1/1981 | DeMonti | 281/15.1 |
| 4,334,771 | 6/1982 | Ryan, Jr. | 283/114 X |
| 4,984,825 | 1/1991 | Fowler | 281/15.1 X |
| 4,991,877 | 2/1991 | Lieberman | 283/36 |
| 5,106,090 | 4/1992 | Greenwood | 281/21.1 X |

FOREIGN PATENT DOCUMENTS

| | | | |
|---|---|---|---|
| 383663 | 3/1908 | France | 40/67 |
| 9787 | of 1896 | United Kingdom | 283/37 |

OTHER PUBLICATIONS

Photocopy of prototype for deck of information cards, published before Aug. 19, 1991.

*Primary Examiner*—Mark Rosenbaum
*Assistant Examiner*—Frances Han
*Attorney, Agent, or Firm*—Jones & Askew

[57] ABSTRACT

A group of cards containing printed information on one or more selected topics and interconnected to form a deck of such cards. The deck may include a title card bearing indicia denoting a particular topic of information on other cards in the deck, and also may include one or more cards containing general information on the topic, as well as subject cards containing information on one or more specific items relating to the topic. The subject cards include indicia, preferably along a marginal portion of the card, denoting the particular subject for which that card, or the facing surface of the card, contains information.

7 Claims, 1 Drawing Sheet

PLANTS
10
11
12
13
14

31
31b
35
42
43
40
41
44
DESCRIPTION:
CARE:

32a
32
45
46
SALVIA 31a
38
COLEUS
39
33
34
HELPFUL HINTS
25
25a
27
28
26
18a
18
20
21
19
TABLE OF CONTENTS
OUTDOOR PLANTS
SHRUBS
50
48
ATLANTA
SCHEDULE:
49
47
47a

APPARATUS FOR ASSEMBLING AND DISPLAYING INFORMATION

This is a continuation of application Ser. No. 08,144,729, filed Oct. 28, 1993, and now abandoned; which in turn is a continuation of Ser. No. 08/032,432 filed Mar. 15, 1993, and now abandoned; which in turn is a continuation of Ser. No. 07/746,911 filed Aug. 19, 1991, and now abandoned.

FIELD OF INVENTION

This invention relates in general to apparatus for displaying information, and in particular relates to such apparatus utilizing a series of cards bearing information on one or more selected topics.

BACKGROUND OF THE INVENTION

People often find themselves in situations where they need or desire information concerning a particular topic. These situations may relate either to work or to leisure activities, but the desired information usually is not readily at hand unless an appropriate book or other information source is available. Although the information may be available from various reference sources such as periodical publications, books, or databases accessible through computers, these sources are not readily portable and in many cases are relatively expensive to purchase and maintain.

Problems associated with providing a convenient source of information on a selected topic are even greater where the information source should be readily portable, that is, sufficiently compact in size and weight so that a person will want to carry it with him or her. Regular hardback bound books are out of the question in most cases, due to the weight and bulk of such books. Even paperback books, although somewhat more convenient to carry than their hardback counterparts, usually do not fit conveniently within a person's pockets, and must instead be carried in a knapsack or some other carrier borne by the individual. Moreover, the bulk and space requirements of conventional bookbinding reduce the amount of information each page can display, and add to the number of pages required for a given amount of information, a significant factor for a portable or easily-carried compendium of information. Moreover, the very nature of bound books makes these books relatively inconvenient or expensive to modify as the information on a few pages is changed from time to time, and the conventional loose leaf alternative to binding usually adds to the weight and physical bulk of a book.

SUMMARY OF INVENTION

Accordingly, it is an object of the present invention to provide improved apparatus for assembling and displaying information.

It is another object of the present invention to provide a relatively compact and easily portable information display apparatus.

It is yet another object of the present invention to organize information on particular subjects relating to a selected topic, and to organize information according to different groups of subjects relating to that topic.

Stated in general terms, the present invention includes a number of individual sheets mutually interconnected to maintain a predetermined sequential arrangement of the sheets. Each sheet has a front surface and a back surface, and at least some of those surfaces bear indicia containing information on particular subjects relating to a selected topic. One sheet, such as the first sheet in the sequence, preferably bears indicia indicating the particular topic of information contained on others of the sheets. The assembly of sheets may also include one or more sheets in the form of an index or table of contents, identifying the information contained on other sheets or surfaces and indicating the particular sheet or surface location containing that information.

Stated somewhat more particularly, the sheets are cards interconnected to form a deck of cards having the predetermined sequential arrangement, and the information on particular subjects relating to a topic is printed on at least one side, and preferably both sides, of each card. The cards preferably are not bound together as pages of a conventional book, but instead are interconnected by a suitable fastener extending through an opening in each card making up the deck.

Stated with further particularity, the cards making up a deck according to the present invention are joined together by a rigid fastener such as a rivet extending through holes formed adjacent a particular corner of the cards. This fastener maintains the cards in the form of a deck, but allows pivoting the cards about the fastener so as to fan the cards on an axis of alignment extending through the aligned openings in the cards making up the deck. The card containing information on a particular subject relating to the topic of the deck is readily accessible by fanning the deck to reach that card, and then pivoting the preceding cards of the deck about the fastener to leave the desired card in substantially full view.

Decks according to the present invention include separate indicia along a marginal portion of each subject card, denoting that subject or a particular attribute of the subject, or both. Where a deck of cards contains information on different groups of subjects relating to a common topic for that deck, the marginal information of the subject cards can denote a specific group of subjects. Other indicia on each card, preferably in the marginal portion thereof, can denote the particular subject within a group or subgroup of subjects.

Other objects and advantages of the present invention will become more readily apparent from the following description of a preferred embodiment.

DETAILED DESCRIPTION OF PREFERRED EMBODIMENT

Figures 1, 2, 3, 4:
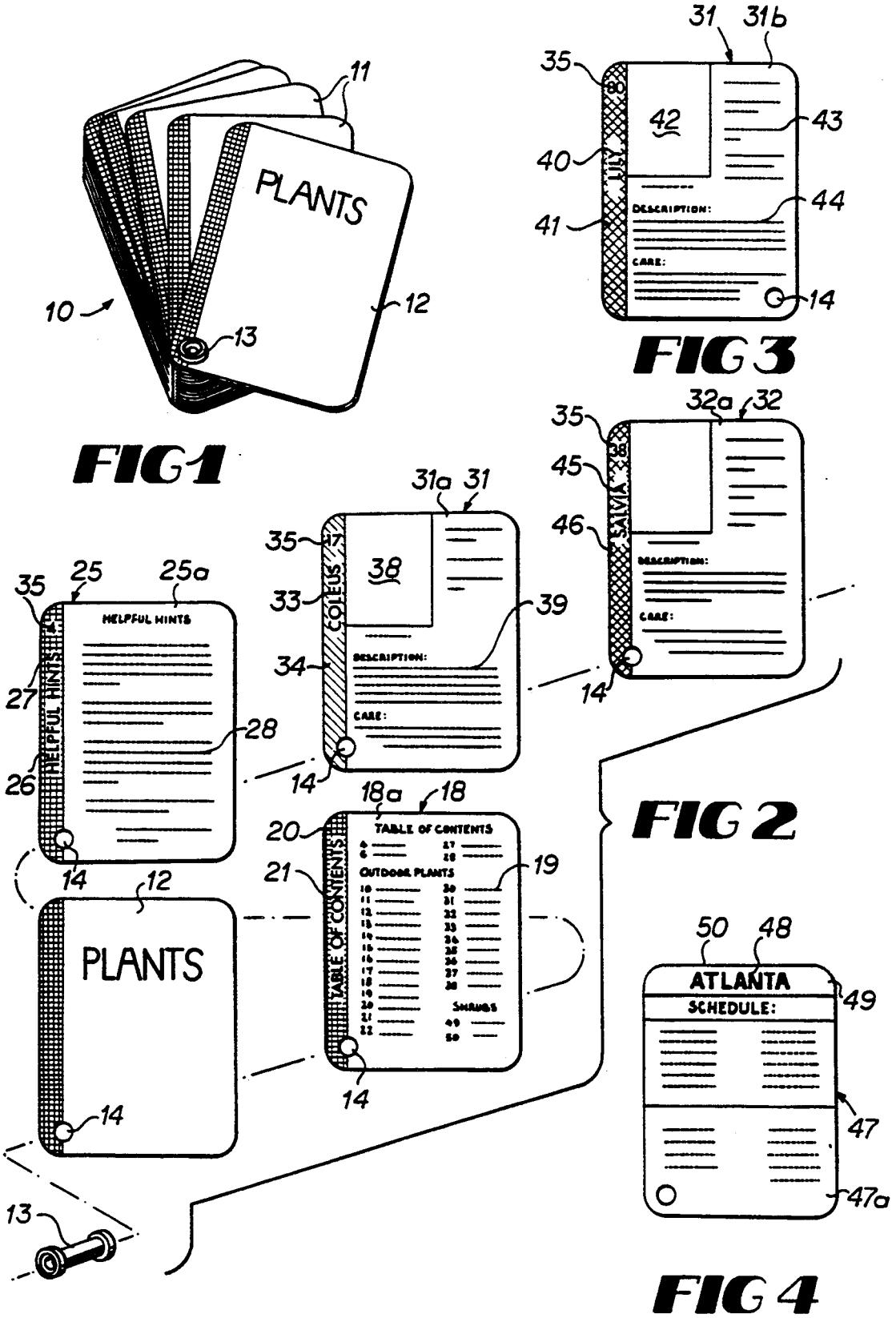
FIG. 1 is a pictorial view showing a partially-fanned deck of information-bearing cards according to a preferred embodiment of the present invention.
FIG. 2 is an exploded view showing representative cards from the deck in FIG. 1.
FIG. 3 shows the back side of one card in the deck of FIGS. 1 and 2.
FIG. 4 shows a typical information card from another deck according to a modification of the preferred embodiment.

Turning first to FIG. 1, there is shown generally at 10 a deck of individual cards 11 containing printed information about a selected topic. In the specific embodiment shown in FIGS. 1 and 2, the topic pertains to horticulture as denoted by the word "plants" printed on the front surface of the card 12 at the top of the deck. The cards 11 are secured together in the deck assemblage by means of a fastener 13 such as a molded plastic rivet or the like, extending through the openings 14 (FIG. 2) formed near the lower-left corner of each card. The rivet 13 in the disclosed embodiment is nonremovable so that the cards 11 making up the deck 10 are not subject to being misplaced or reassembled out of order by users of the deck. However, it is considered within the scope of the present invention to replace the nonremovable fastener 13 with a removable fastener of known kind, for use in applications where the information appearing on the removable cards 11 is likely to be updated piecemeal from time to time. For other applications where information on all cards of the deck is likely to remain static at least for a time, e.g., for a particular season in the case of a deck pertaining to sports teams and containing schedules and rosters for the teams, a fastener of the nonremovable kind generally is preferred. In any case, it is seen from FIG. 1 that the fastener 13 maintains the cards 11 in a predetermined sequential arrangement, with the cards being mutually parallel but capable of being fanned outwardly as shown in FIG. 1. This structural arrangement of the deck 10 allows fanning the cards so that any particular card beneath the top card 12 becomes visible almost in its entirety, as the cards above that particular card are rotated approximately 180°.

Turning next to FIG. 2, there is shown the nature of selected cards in the deck 10 and the layout of indicia used for indexing and displaying the information on those cards. The top card 12 typically contains wording as described above, and identifying the particular topic or topics of information printed on at least some other cards making up the deck. Immediately following the top card 12, in the disclosed example, are one or more contents cards 18 containing the words "Table of Contents" or similar nomenclature near the top of the card, and also including other indicia 19 naming the information appearing on the specific subject cards following the contents cards in the deck 10. If the information printed on the subject cards falls within two more logical groups of subjects relating to a topic of the deck 10, those different information groups preferably are identified as such by appropriate visual techniques, such as subheadings of bold or otherwise-characteristic type, in the contents indicia 19. Each line item of information appearing on the index card preferably has an index such as a number identifying the particular card or card surface on which that information first occurs.

Appearing along the left marginal portion 20 of the contents card 18 as indicia 21 denoting or identifying the subject matter appearing on that particular card, or at least on the front surface 18*a* of that card. The indicia 21 preferably includes words such as "Table of Contents" identifying information on the card, as well as nonverbal information identifying a particular kind or class of information characteristic of that found on the front surface 18*a*. For example, the indicia 21 on the front surface 18*a* of the card 18 may comprise a border of characteristic color printed along the left marginal portion 20 of the card 18, with the legend "Table of Contents" printed therein. In the particular example given, the indicia 21 for the contents information on the front surface 18*a* of the card 18 is colored yellow. This color is selected to denote indicia of general interest or assistance relative to the entire contents of the deck 10.

The next card 25 shown in the exploded deck of FIG. 2 contains helpful hints on its front surface 25*a* and is so identified by the printed indicia "Helpful Hints" near the top of the front surface. The further indicia 26 appears along the left marginal portion 27 of the front surface 25*a*, and may contain the same title showing the contents of the front surface. The indicia 26 at the left marginal portion of the card preferably has the same color or other nonverbal characteristic as the indicia 21 on the front surface 18*a* of the card 18, indicating that the front surfaces 18*a* and 25*a* each contain information of a general nature pertaining to the topic of the entire deck 10. The indicia 28 appearing below the title near the top of the front surface 25 can be any information of a general or specific nature relating to plants, such as planting, watering, fertilizing, and otherwise caring for the various kinds of plants more particularly identified in the subject cards appearing elsewhere in the deck 10.

Although a single card surface 25*a* for plant hints is depicted in FIG. 2, it should be understood that this category of general information can be continued on one or more additional card surfaces in the deck. Those additional card surfaces, if they exist, preferably should follow immediately behind the surface 25*a* on the card 25 for easy and logical access by persons using the deck. Moreover, the card or cards containing hints can be followed in the deck by one or more further cards bearing other information of a general nature relating to a topic of the deck.

Following the general-information card surfaces in the deck 10 are a number of subject cards 31, 32, . . . and so on. Only the two specific subject cards 31 and 32 are shown in FIG. 2, but it will be understood that the number of such cards in a particular deck 10 is limited only by practical considerations relating to the maximum desired thickness of a deck comprising the selected number of subject cards. In the deck of the preferred embodiment, each subject card contains information on the particular plant belonging to a group of plants as defined by horticultural or other characteristics, and preferably as set forth in the indicia 19 on the front surface 18*a* of the contents card. For example, the card 31 identifies a plant known as "coleus", and that plant name appears at 33 in the indicia band 34 along the left marginal portion of the front surface 31*a*. coleus is deemed an outdoor plant, and the indicia 34 preferably contains nonverbal indicia distinctive of outdoor plants as a group or category of information contained on the various subject cards. In the specific example, the indicia band comprises a green band along the left marginal portion of the front surface 31*a*, with the word "coleus" appearing superimposed in that colored band. A page number indicated at 35 preferably appears at one end of the indicia along the marginal portion of the front surface 31*a*, and that page number is keyed to the numerical index contained in the indicia 19 on the contents card. A person seeking information about the particular plant coleus thus can find that card by first reading the Table of Contents on the card surface 18*a* to determine the page number, and then fanning the cards as shown in FIG. 1 so that the page numbers become visible at the upper end of the marginal indicia on the several cards. Alternatively, a person using the deck could skip the Table of Contents and refer directly to the plant names appearing at 33 in the indicia strips; the plants preferably appear in alphabetical order on the faces 31*a*, 32*a*, . . . of the subject cards.

Each subject card, as exemplified by the subject cards 31 and 32 shown in FIG. 2, contain information about a particular subject under the general tonic of the deck 10 and if applicable, under a particular group of subgroup of subjects as outlined on the contents cards 18. Furthermore, in the specific embodiment disclosed herein, the front surface 31*a* and the back surface 31*b* of the subject card 31 contain information on different subjects, namely, different species of plants, as is explained below in greater detail. However, it is within the scope of the present invention that both the front and back surfaces of a particular subject card can contain information about a single subject.

The front surface 31 contains a 38 a pictorial representation of the plant "coleus", the subject matter on that card surface. This pictorial representation may be a photograph in color, showing a particular variety of coleus. Immediately to the right of the pictorial representation 30 is printed information setting forth attributes of that particular plant. For example, this information may state that coleus is a "Shade tolerant annual" preferring "rich, moist soil" and growing best in "light to heavy shade". The information to the right of the pictorial representation 38 thus gives the reader some immediate and basic knowledge about the subject described on the front surface 31*a*.

The remainder of the front surface 31*a*, appearing below the pictorial representation 38, preferably contains other information relating to coleus and of interest to plant growers or others. For example, the region 39 can contain a brief description about coleus, including the nature and color of the plant and its leaves as well as other information, and can include a section on preferred care for that particular plant.

Thus, the typical subject card 31, and in particular the front surface 31*a*, describes a particular plant indicated by the name indicia 33 at the left marginal portion of the front surface, and falling under a particular group of plants ("Outdoor Plants") indicated by the nonverbal indicia 34 also at the left margin of the front surface 31*a*.

FIG. 3 shows the back surface 31*b* of the card 31. This back surface 31*b*, as mentioned above, contains information on another plant, namely, the lily. The name of this plant appears at 40 in the left marginal portion of the back surface 31*b*, within the further indicia 41 of a nonverbal nature. In a specific embodiment, this nonverbal indicia 41 is a marginal stripe colored orange and extending the length of the back surface 31*b*, the color orange selected to identify bulbs.

The back surface 31*b*, as with the front surface of the card 31, contains a photograph 42 of a particular variety of lily, and includes indicia 43 to the right of the photograph setting forth some attributes of such plants. Further indicia 44 below the photograph 42 include a brief general description of lilies and advice on caring for such plants.

Turning next to the subject card 32 shown in FIG. 2, that the front surface 32*a* of that card is chosen to depict the plant salvia. It should be understood that a typical desk according to the present invention can have many more subject cards than the small number shown in FIG. 2, and that the cards for coleus and salvia are not necessarily contiguous in the deck 10. Further details of the subject card 32 need not be discussed herein, as the information contained on the front surface 32*a* of that card is similar in kind and location to that of the subject card surfaces 31*a* and 31*b* described above. In common with the other subject card surfaces, however, the front surface 32*a* includes at its left margin the verbal indicia 45 identifying the particular plant forming the subject matter of that surface, and the nonverbal indicia 46 identifying the particular group or subgroup of that subject matter.

It should now be apparent that decks according to the present invention can display information on topics virtually without limit. A typical subject card 47 from another such deck is shown in FIG. 4. This subject card 47 is part of an information deck whose topic is professional football, and it will be understood that a complete deck on that topic can contain numerous subject cards, in addition to various cards displaying general information analogous to the hints card 25 and contents card 18 shown and described with respect to FIG. 2. The specific subject card 47, and in particular the front surface 47*a* of that card, deals with the particular subject of a professional football team in Atlanta, and that subject is identified by the text 48 appearing in the marginal band 49 of indicia located adjacent the top surface 50 of the card. The body of the front surface 47*a* contains indicia 51 denoting the playing schedule for the Atlanta professional football team. If the schedule information and size of the card permit, the schedule of another team can appear on the lower half of the front surface 47*a*.

Other topics suitable for inclusion on subject cards of a professional football deck include the roster of players on each team for a particular season, the teams within particular divisions or other groupings in a professional football league, team standings and won-lost records from one or more previous playing seasons, and other information as desired by the preparer of the deck.

It should be understood that the foregoing relates only to a preferred embodiment of the present invention, and that numerous modifications and changes therein may be made without departing from the spirit and scope of the invention as defined in the following claims.

What is claimed is:

1. Apparatus for assembling and displaying information in predetermined format, comprising:

a plurality of cards each having a front surface and a back surface;

means mutually interconnecting the cards to maintain a predetermined sequential arrangement of the cards;

the first card in the sequence bearing indicia indicating a particular topic of information contained in others of the cards;

a plurality of the other cards being subject cards bearing indicia containing information on particular subjects relating to the topic;

the subject cards including indicia containing information on different groups of subjects relating to the topic; and each subject card including subject indicia along a marginal portion of the card and denoting a specific one of the groups of subjects, so that a person can locate the cards for a particular subject groups by selecting the subset of cards having the corresponding marginal subject indicia and moving the selected cards within respect to the interconnecting means.

2. Apparatus in claim 1, wherein:

the marginal subject indicia for the cards of a particular group comprises a nonverbal indicium on those cards, characterizing the cards of that group and distinct from the nonverbal subject indicia on the cards of other groups.

3. Apparatus as in claim 2, wherein:

the marginal subject indicia for the cards of a particular group also contain a further indicium identifying the specific item of that group for which information appears on the card.

4. Apparatus as in claim 3, wherein:

the nonverbal marginal indicia comprise a specific color common to all cards of a particular group; and the further indicia comprise verbal indicia identifying the specific items within each group.

5. Apparatus as in claim 3, wherein:

at least some of the subject cards bear indicia containing information on dissimilar subjects on front and back sides of the card; and each side of said same cards includes marginal indicia identifying the particular group corresponding to the information on that particular side.

6. Apparatus as in claim 1, further comprising:

an index card included in the plurality of cards and containing indicia corresponding to specific subject matter on the sides of the subject cards and to the location of those sides in the sequential arrangement of cards.

7. Apparatus as in claim 1, wherein:

the interconnecting means extends through an opening in each card and retains the cards in the form of a deck with the openings axially aligned, so that the cards are pivotable around the means to permit fanning the cards on the axis of alignment.

* * * * *